US009033747B2

(12) United States Patent
Sato et al.

(10) Patent No.: US 9,033,747 B2
(45) Date of Patent: May 19, 2015

(54) CONNECTOR

(71) Applicant: YAZAKI CORPORATION, Tokyo (JP)

(72) Inventors: Akira Sato, Shizuoka (JP); Kenji Takahashi, Shizuoka (JP); Hideki Ohsumi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 13/862,051

(22) Filed: Apr. 12, 2013

(65) Prior Publication Data

US 2013/0224979 A1 Aug. 29, 2013

Related U.S. Application Data

(63) Continuation of application No. PCT/JP2011/074233, filed on Oct. 14, 2011.

(30) Foreign Application Priority Data

Oct. 14, 2010 (JP) ..... 2010-231768

(51) Int. Cl.
*H01R 13/405* (2006.01)
*H01R 13/52* (2006.01)

(52) U.S. Cl.
CPC ..... *H01R 13/521* (2013.01); *H01R 13/5202* (2013.01); *H01R 13/5216* (2013.01); *H01R 2201/26* (2013.01)

(58) Field of Classification Search
USPC ..... 439/936, 736, 589, 587
See application file for complete search history.

(56) References Cited

U.S. PATENT DOCUMENTS

| | | | | |
|---|---|---|---|---|
| 4,538,020 | A | 8/1985 | Tucker | |
| 5,518,415 | A * | 5/1996 | Sano | 439/204 |
| 5,630,732 | A | 5/1997 | Yamanashi | |
| 5,637,007 | A * | 6/1997 | Suzuki et al. | 439/276 |

FOREIGN PATENT DOCUMENTS

| | | | |
|---|---|---|---|
| CN | 101820117 | A | 9/2010 |
| GB | 2 104 736 | A | 3/1983 |
| JP | 8-17512 | A | 1/1996 |
| JP | 2000-260517 | A | 9/2000 |
| JP | 2010-182493 | A | 8/2010 |

OTHER PUBLICATIONS

International Search Report and Written Opinion of the International Search Report for PCT/JP2011/074233 dated Dec. 28, 2011.
Japanese Office Action for the related Japanese Patent Application No. 2010-231768 dated Aug. 19, 2014.
Chinese Office Action for the related Chinese Patent Application No. 201180049779.0 dated Nov. 17, 2014.
European Office Action for the related European Patent Application No. 11 778 994.1 dated Mar. 10, 2015.

* cited by examiner

*Primary Examiner* — Phuong Dinh
(74) *Attorney, Agent, or Firm* — Kenealy Vaidya LLP

(57) ABSTRACT

A connector includes an inner plate including cavities for holding terminals connected to electric wires, a cylindrical housing which accommodates therein the inner plate, and a filling material which is filled in an interior of the housing so as to surround a periphery of the inner plate. A plurality of air bleeding holes are formed in a portion of the inner plate other than portions where the cavities are provided so as to penetrate from a front side to a back side thereof.

3 Claims, 7 Drawing Sheets

FIG. 9 -- Related Art --
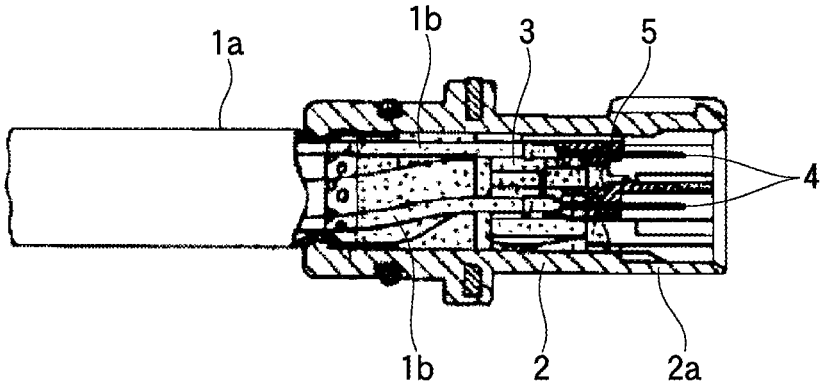

CONNECTOR

CROSS REFERENCE TO RELATED APPLICATION

This application is a continuation of PCT application No. PCT/JP2011/074233, which was filed on Oct. 14, 2011 based on Japanese Patent Applications No. 2010-231768 filed on Oct. 14, 2010, the contents of which are incorporated herein by reference.

BACKGROUND OF THE INVENTION

1. Technical Field

The present invention relates to a connector having a sealing construction which is mounted, for example, in an engine compartment or an automatic transmission of a motor vehicle for establishing a connection between circuits inside and outside the engine compartment or the automatic transmission.

2. Background Art

High sealing properties such as waterproofing or oil proofing properties are required for a connector that is mounted in an engine compartment or an automatic transmission of a motor vehicle for establishing a connection between circuits inside and outside the engine compartment or the automatic transmission. As a connector having such a sealing construction, there are known connectors in which a resin filling material is filled in an interior of a housing thereof (for example, refer to JP-A-2000-260517 and JP-A-2010-182493).

As FIG. 9 shows, in a connector having such a sealing construction, terminal portions of electric wires 1*b* covered with a rubber tube 1*a* as a cover are connected to a connector housing 2. A bush 2*a* is provided on the connector housing 2 for use in connection with a mating connector.

An inner plate 5 is provided within the connector housing 2, and terminals 4 which are connected to the electric wires 1*b* are held on the inner plate 5. A filling material 3 of an epoxy resin, for example, is filled and set in a space defined by the rubber tube 1*a*, the bush 2*a* and the inner plate 5, so as to prevent the intrusion of an external liquid such as water or oil into the connector housing 2.

SUMMARY OF THE INVENTION

Incidentally, the inner plate 5 provided in the connector described above is formed into a complicated shape for holding the terminals 4. Because of this, when the filling material 3 is filled in the space defined by the rubber tube 1*a*, the bush 2*a* and the inner plate 5, the filling material 3 is not allowed to smoothly enter complicatedly shaped portions in the inner plate 5, whereby air voids are produced in the filling material 3 so filled, leading to fears that the sealing properties are reduced.

Consequently, the filling speed of the filling material 3 is slowed so as to suppress the production of non-filled portions such as air voids where the filling material 3 is not filled, and this calls for an increase in production costs due to a reduction in production efficiency.

The invention has been made in view of these situations, and an object thereof is to provide a connector having superior sealing properties which can realize a reduction in production costs by increasing the production efficiency.

With a view to attaining the object, according to the invention, there is provided a connector characterized by configurations described under (1) and (2) below.

(1) A connector including:

an inner plate including cavities for holding terminals connected to electric wires;

a cylindrical housing which accommodates therein the inner plate; and a filling material which is filled in an interior of the housing so as to surround the periphery of the inner plate, wherein plural air bleeding holes are formed in a portion of the inner plate other than the portions where the cavities are provided so as to penetrate from a front side to a back side thereof.

(2) A connector as set forth under (1) above, wherein the housing is closed with a sealing plug at a rear end side, and wherein the filling material is filled into an interior of the housing which is closed by the sealing plug to a position where the inner plate is covered therewith from the rear end side.

In the connector configured as set forth under (1), the plural air bleeding holes are formed in the other portion of the inner plate than the portions where the cavities are provided so as to penetrate from the front side to the back side of the inner plate. Therefore, in filling the filling material into the interior of the housing, the occurrence of a drawback is prevented in which air in the interior of the housing remains on the peripheries of the cavities to form air voids. By preventing the production of air voids in this way, the filling material can be filled into the interior of the housing quickly and smoothly, thereby making it possible to realize a reduction in production costs as a result of an increase in productivity while ensuring high sealing properties.

In the connector configured as set forth under (2), in filling the filling material into the interior of the housing which is closed with the sealing plug to the position where the inner plate is covered therewith from the rear end side, air staying on the peripheries of the cavities in the inner plate is discharged to the outside through the air bleeding holes. By adopting this configuration, the occurrence of the drawback is prevented in which air in the interior of the housing remains on the peripheries of the cavities to form air voids.

According to the invention, the connector can be provided which has superior sealing properties and which can realize a reduction in production costs through efficient production.

Thus, the invention has been briefly described. Further, the details of the invention will be made clearer through perusal of Description of Embodiments that will be described below while referring to the accompanying drawings.

BRIEF DESCRIPTION OF THE DRAWINGS

FIG. 4A is a front view and FIG. 4B is a sectional view.

FIG. 5A is a front view and FIG. 5B is a sectional view.

FIG. 6A to 6D are perspective views of the connector which is sectioned longitudinally.

FIG. 8A is a front view and FIG. 8B is a sectional view.

FIG. 9 is a sectional view of a connector which depicts the construction of a connector in related art.

DETAILED DESCRIPTION OF THE EXEMPLARY EMBODIMENTS

Hereinafter, an embodiment of the invention will be described by reference to the drawings.

Figure 1:
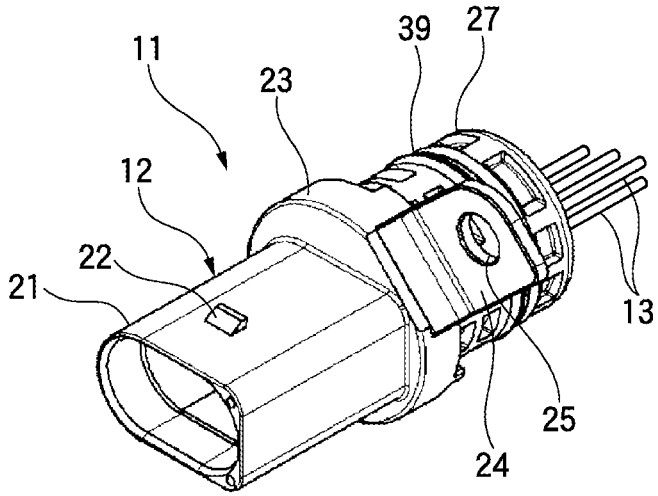
FIG. 1 is a perspective view of a connector according to an embodiment of the invention.
Figure 2:
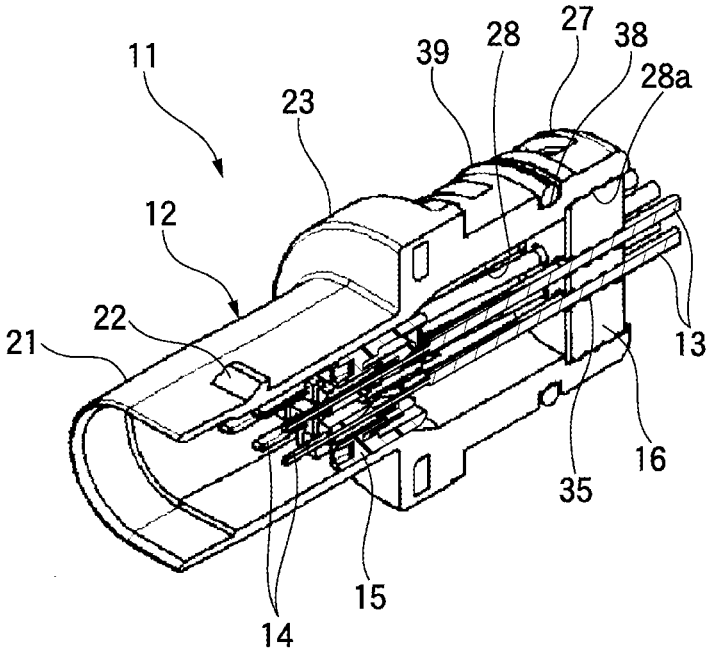
FIG. 2 is a perspective view of the connector according to the embodiment which is sectioned longitudinally.
Figure 3:
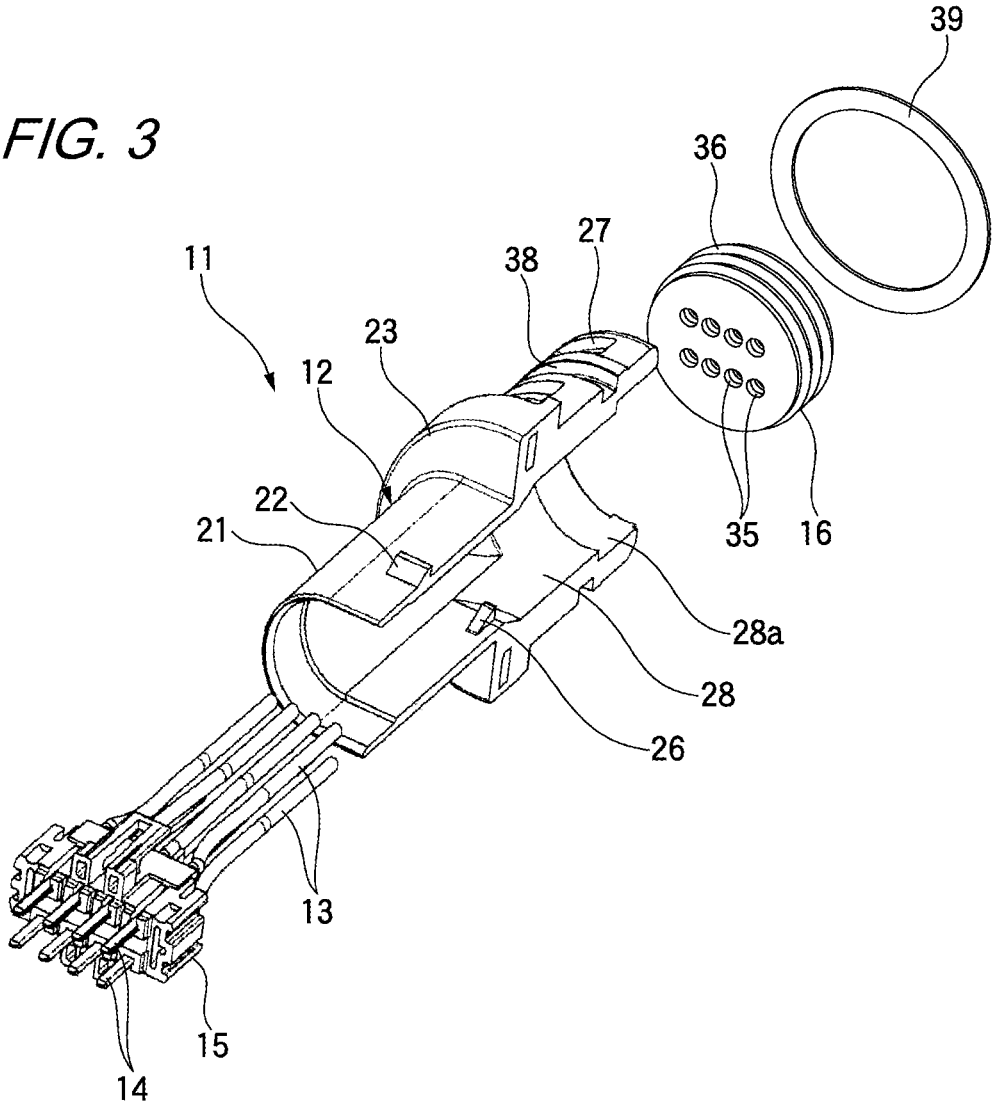
FIG. 3 is an exploded perspective view of a housing of the connector according to the embodiment which is sectioned longitudinally.
Figure 4B:
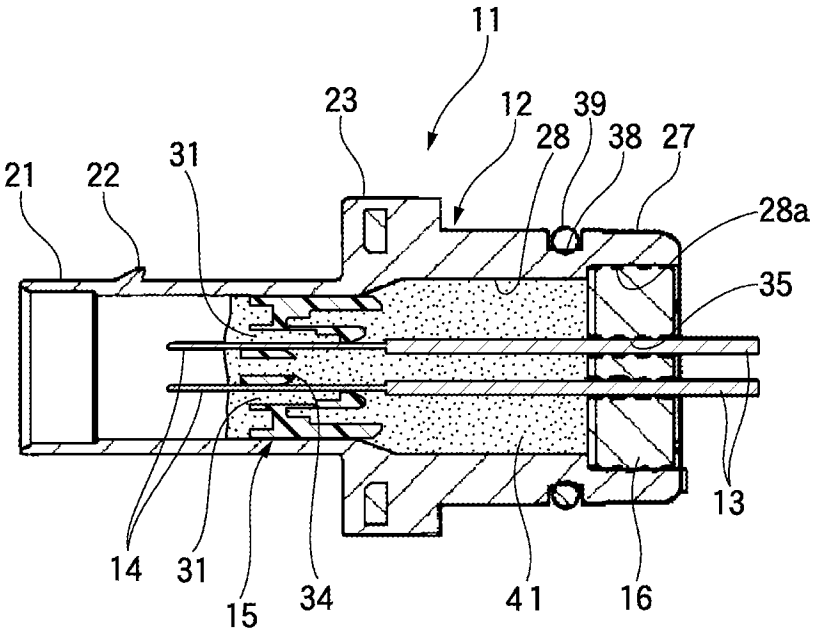
FIGS. 4A and 4B show diagrams depicting the connector according to the embodiment.
Figure 4A:
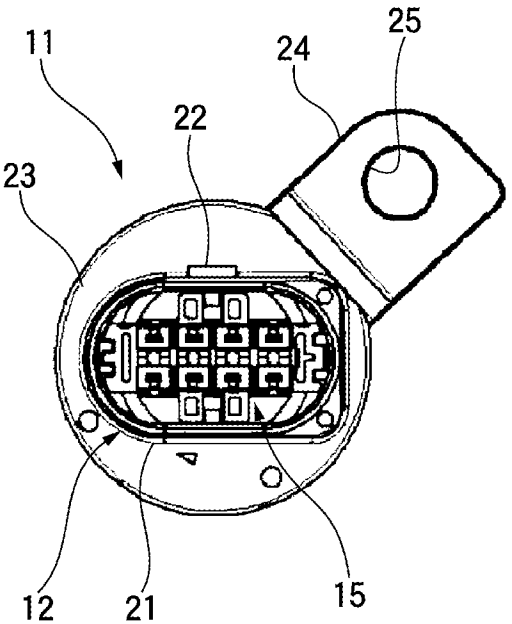
Figure 5A:
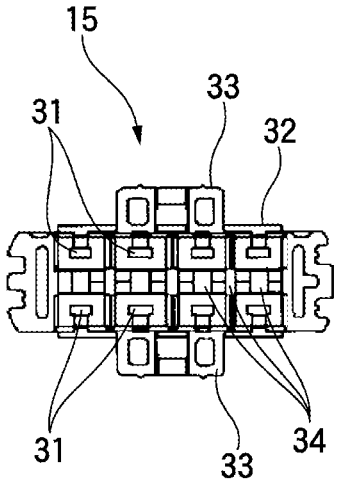
FIGS. 5A and 5B show diagrams depicting an inner plate which is to be accommodated in the housing of the connector.
Figure 5B:
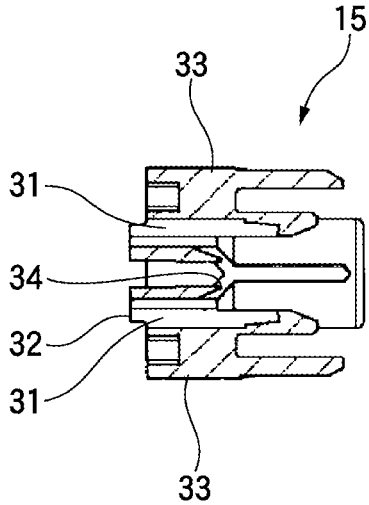

FIG. 1 is a perspective view of a connector according to an embodiment of the invention, FIG. 2 is a perspective view of the connector according to the embodiment which is sectioned longitudinally, FIG. 3 is an exploded perspective view of a housing of the connector according to the embodiment which is sectioned longitudinally, FIGS. 4A and 4B show diagrams depicting the connector according to the embodiment. FIG. 4A is a front view and FIG. 4B is a sectional view. FIGS. 5A and 5B show diagrams depicting an inner plate which is to be accommodated in the housing of the connector. FIG. 5A is a front view and FIG. 5B is a sectional view.

As FIGS. 1 to 4B show, a connector 11 according to this embodiment has a cylindrical housing 12. Terminals 14 made of a conductive metallic material are disposed in an interior the housing 12, and the terminals 14 are connected to end portions of plural electric wires 13 through crimping or the like. The terminals 14 are individually connected to an inner plate 15 which is accommodated in the interior of the housing 12. In addition, the electric wires 13 are held in a sealing plug 16 which is fitted in the housing 12 at a rear end side thereof.

A distal end side of the housing 12 is configured as a connecting end 21 which is formed into an oval shape in section, and a mating connector (not shown) is connected to this connecting end 21, whereby the terminals 14 of the connector 11 are connected to terminals of the mating connector for establishing an electric continuity.

A claw portion 22 is formed on an outer circumferential surface of the connecting end 21. When the connecting end 21 is connected to the mating connector, the claw portion 22 is brought into engagement with the mating connector.

The rear end side of the housing 12 is configured as a fixing end 27, and this fixing end 27 side of the housing 12 is formed into a circular shape in section.

The fixing end 27 of the housing 12 is inserted into a connection hole (not shown) which is formed in an engine compartment or a case of an automatic transmission of a motor vehicle for connection.

A flange portion 23 is formed at a longitudinal intermediate portion of the housing 12 so as to extend over a circumferential direction while projecting radially outwards. When the fixing end 27 is inserted into the connection hole in the case, the flange portion 23 is brought into abutment with the case. A fixing piece 24 is formed on the flange portion 23 so as to extend radially outwards. An insertion hole 25 is formed in the fixing piece 24, and the connector 11 is fixed to the case by inserting a bolt (not shown) through the insertion hole and screwing the bolt into a threaded hole (not shown) formed in the case.

In addition, the fixing end 27 of the housing 12 has a groove portion 38 which is formed fully circumferentially on an outer circumference of the fixing end 27, and an O-ring 39 is fittingly mounted in this groove portion 38.

By adopting this configuration, when the fitting end 27 of the housing 12 is inserted into the connecting hole in the case, a seal is formed between an inner circumferential surface of the connecting hole and an outer circumferential surface of the fixing end 27 of the housing 12 by the O-ring 39.

A hole portion 28 having a circular shape in section is formed at the fixing end 27 side of the housing 12. A large diameter portion 28*a* is formed at an end portion of the hole portion 28, and the sealing plug 16, which is formed into a disk-like shape, is fitted in the large diameter portion 28*a*.

The sealing plug 16 is formed of a rubber, for example, and has plural insertion holes 35 through which the electric wires 13 are inserted so as to penetrate through the sealing plug 16 from a front side to a back side thereof. The electric wires 13 which are connected to the corresponding terminals 14 are inserted through the corresponding insertion holes 35. The sealing plug 16 has an elongated sealing projection 36 which is formed fully circumferentially on an outer circumferential surface thereof. When the sealing plug 16 is fitted in the large diameter portion 28*a* of the housing 12, the elongated sealing projection 36 is brought into tight contact with an inner circumferential surface of the large diameter portion 28*a* of the housing 12.

An engagement claw 26 is formed on an inner circumferential surface of the connecting end 21 of the housing 12 which is constructed as has been described above. This engagement claw 26 is brought into engagement with the inner plate 15 which is inserted from the distal end side of the housing 12. By this engagement, the inner plate 15 is prevented from being dislodged from the housing 12 by means of an engagement force with the engagement claw 26.

As shown in FIGS. 5A and 5B, the inner plate 15 adapted to be inserted from the connecting end 21 side of the housing 12 has a terminal holding portion 32 and engagement portions 33. The terminal holding portion 32 is formed into a rectangular shape as viewed from the top thereof and has plural cavities 31 arranged in upper and lower rows. The engagement portions 33 are provided at a central portion with respect to a widthwise direction of the terminal holding portion 32 at upper and lower sides of the central portion. The terminals 14 connected to the corresponding electric wires 13 are inserted into the plural cavities 31 formed in the terminal holding portion 32 from the rear end side so as to be held therein. In addition, on the inner plate 15, plural air bleeding holes 34 are formed along a direction in which the cavities 31 are arranged in a portion of the terminal holding portion 32 other than the portions where the cavities 31 are formed which lies between the upper and lower rows of cavities 31.

The inner plate 15 is inserted from the connecting end 21 side of the housing 12 and is restricted from moving in an opposite direction to the inserting direction by the engagement claw 26 being brought into engagement with the engagement portion 33.

A filling material 41 formed of an epoxy resin or the like is filled in a portion in the interior of the housing 12 which lies further forwards than the sealing plug 16. The inner plate 15 is covered with the filling material 41.

By this configuration, in this connector 11, the inner plate 15 which holds the terminals 14 and the portion in the interior of the housing 12 which lies further rearwards than the inner plate 15 are sealed by the filling material 41. Consequently, in this connector 11, even in the event that rain water or oil enters from the connecting portion with the mating connector, a drawback is prevented in which the rain water or oil that has entered the connector 11 intrudes into the engine compartment or the case of the automatic transmission of the motor vehicle through the interior of the housing 12.

Next, the assemblage of the connector 11 will be described.

Figure 6A:
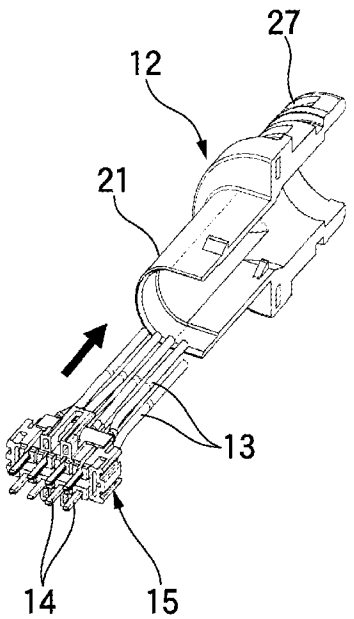
FIGS. 6A to 6D show diagrams explaining an assembling procedure of the connector.
Figure 6B:
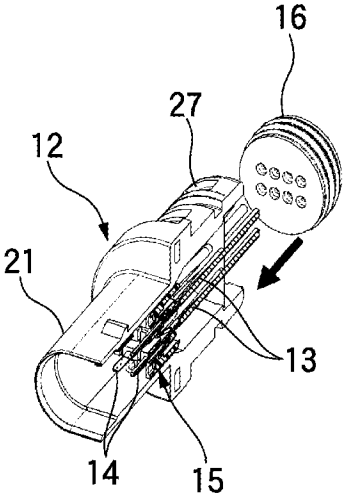

FIGS. 6A and 6B show diagrams explaining an assembling procedure of the connector. FIGS. 6A to 6D are perspective views of the connector which is sectioned longitudinally.

As FIG. 6B shows, the terminals 14 are connected to the electric wires 13 which are inserted into the housing 12 from the rear end side thereof in advance. Then, the terminals 14 are inserted into the cavities 31 in the inner plate 15 so as to be held therein. The electric wires 13 are inserted through the insertion holes 35 in the sealing plug 16 in advance.

Then, the inner plate 15 which holds the terminals 14 is inserted into the housing 12 from the connecting end 21 side thereof, and the engagement claw 26 is brought into engagement with the engagement portion 33 of the inner plate 15.

Next, as FIG. 6B shows, the sealing plug 16 is fitted in the large diameter portion 28*a* of the housing 12 from the fixing end 27 at the rear end side of the housing 12.

Figure 6C:
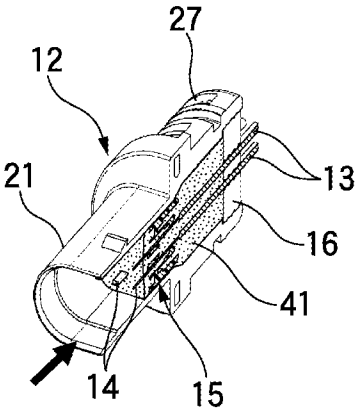

Thereafter, as FIG. 6C shows, the filling material 41, which is formed of the epoxy resin or the like, is filled into the interior of the housing 12 from the distal end side thereof. The filling material 41 is so filled with the distal end side of the housing 12 oriented upwards. The filling material 41 is filled to a position where the inner plate 15 is embedded in the filling material 41. As this occurs, air staying between the sealing plug 16 and the inner plate 15 in the interior of the housing 12 is discharged to the outside of the housing 12 from a gap between the housing 12 and the inner plate 15 as the filling material 41 is filled into the housing 12. By the air escaping in the way described above, the filling material 41 is filled smoothly between the sealing plug 16 and the inner plate 15 in the interior of the housing 12.

In addition, the plural air bleeding holes 34 are formed in the terminal holding portion 32 of the inner plate 15 which is the portion other than the portions where the cavities 31 are provided along the direction in which the cavities 31 are arranged. Thus, when the filling material 41 is filled, air staying between the sealing plug 16 and the inner plate 15 in the interior of the housing 12 is discharged smoothly to the outside of the housing 12 from the air bleeding holes 34. By the air escaping in the way described above, no air void is produced in the interior of the housing 12, and therefore, the filling material 41 is filled into the housing 12 quickly and smoothly.

Figure 6D:
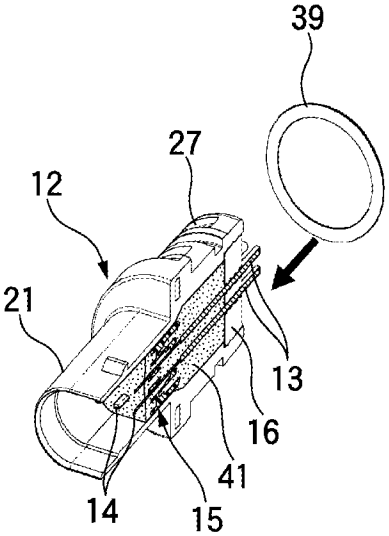

When the filling material 41 is set, as FIG. 6D shows, the O-ring 39 is fitted to be mounted in the groove portion 38 formed circumferentially along the outer circumference of the rear end side of the housing 12.

Thus, as has been described heretofore, according to the connector of this embodiment, the plural air bleeding holes 34 are formed in the portion of the inner plate 15 which holds the terminals 14 other than the portions where the cavities 31 are formed so as to penetrate the portion from the front side to the back side. Thus, when the filling material 41 is filled into the portion in the interior of the housing 12 which extends from the rear end side to the position where the inner plate 15 is covered by the filling material 41, the drawback is prevented in which air in the interior of the housing 12 remains on the peripheries of the cavities 31 to thereby produce air voids. By this configuration, the filling material 41 can be filled into the interior of the housing 12 quickly and smoothly, thereby making it possible to realize a reduction in production costs due to the increase in productivity while ensuring the high sealing properties.

Here, a reference example will be described to explain further the superiority of the invention.

Figure 7:
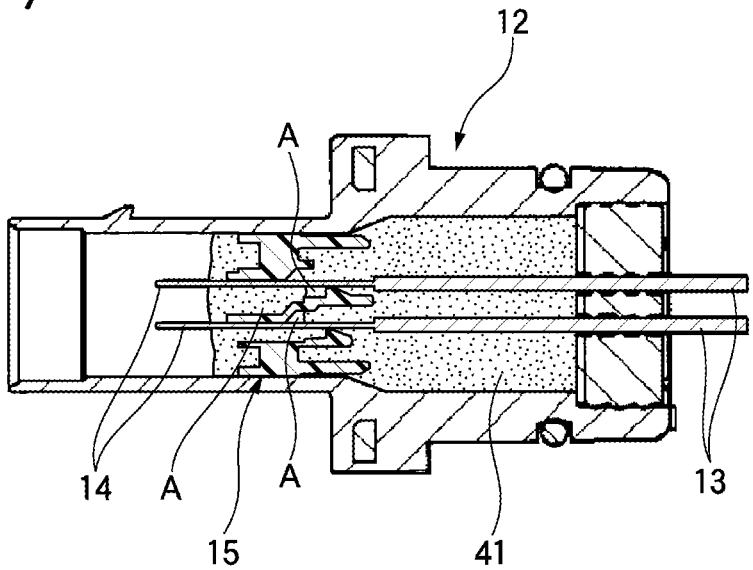
FIG. 7 is a sectional view of a connector according to a reference example.
Figure 8A:
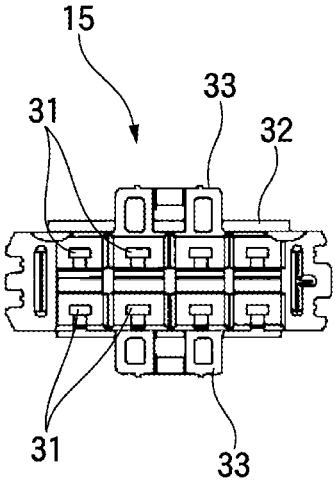
FIGS. 8A and 8B show diagrams depicting an inner plate which makes up the connector according to the reference example.
Figure 8B:
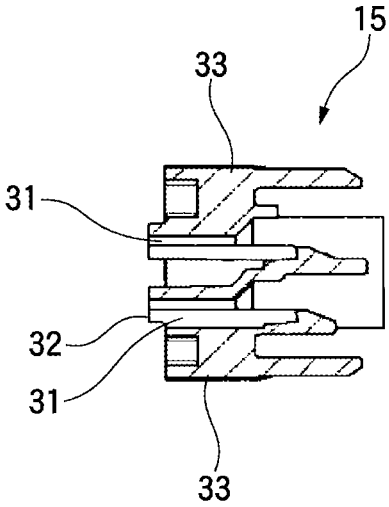

FIG. 7 is a sectional view of a connector according to a reference example, and FIGS. 8A and 8B show diagrams depicting an inner plate which makes up the connector according to the reference example. FIG. 8A is a front view and FIG. 8B is a sectional view.

As FIGS. 7, 8A and 8B show, this connector differs from the connector according to the embodiment in that no air bleeding hole 34 is formed in an inner plate 15.

In the connector including the inner plate 15 having no such air bleeding hole 34, when a filling material 41 is filled into an interior of a housing 12, air staying between a sealing plug 16 and the inner plate 15 enters complicated portions of the inner plate 15 and remains without being discharged, leading to fears that air voids A are formed.

Because of this, in the connector including the inner plate 15 having no such air bleeding hole 34, the filling speed of the filling material 41 needs to be slowed so as to suppress the production of non-filled portions such as air voids A where the filling material 41 is not filled, this calling for an increase in production costs due to a reduction in production efficiency.

The invention is not limited to the embodiment that has been described heretofore but can be modified or improved as required. In addition, the material, shape, dimensions, number and locations of the individual constituent elements of the embodiment are arbitrary and hence are not limited to those described in the embodiment, provided that the invention can be attained.

According to the invention, the connector can be provided which has superior sealing properties and which can realize a reduction in production costs through efficient production.

REFERENCE SIGN LIST

11 connector
12 housing
13 electric wire
14 terminal
15 inner plate
16 sealing plug
31 cavity
34 air bleeding hole
41 filling material

What is claimed is:

1. A connector comprising:

an inner plate including cavities for holding terminals connected to electric wires;

a cylindrical housing which accommodates therein the inner plate; and a filling material which is filled in an interior of the housing so as to surround a periphery of the inner plate, wherein a plurality of air bleeding holes are formed in a portion of the inner plate other than portions where the cavities are provided, the plurality of air bleeding holes penetrate from a front side of the inner plate to a back side of the inner plate.

2. A connector as set forth in claim 1, wherein the housing is closed with a sealing plug at a rear end side, and wherein the filling material is filled into an interior of the housing which is closed by the sealing plug to a position where the inner plate is covered therewith from an inner side face of the sealing plug which faces the interior of the housing.

3. The connector as set forth in claim 1, wherein the cavities are arranged in an upper row and a lower row; and the plurality of air bleeding holes are arranged between the upper row and the lower row.

* * * * *